US005489914A

United States Patent [19]

Breed

[11] Patent Number: 5,489,914

[45] Date of Patent: Feb. 6, 1996

[54] METHOD OF CONSTRUCTING MULTIPLE-FREQUENCY DIPOLE OR MONOPOLE ANTENNA ELEMENTS USING CLOSELY-COUPLED RESONATORS

[76] Inventor: Gary A. Breed, 7318 S. Birch St., Littleton, Colo. 80122

[21] Appl. No.: 280,784

[22] Filed: Jul. 26, 1994

[51] Int. Cl.[6] ..... H01Q 19/10

[52] U.S. Cl. ..... 343/818; 343/819; 343/846

[58] Field of Search ..... 343/810, 812, 343/815, 817, 818, 819, 792, 792.5, 793, 833, 834, 835, 836

[56] References Cited

U.S. PATENT DOCUMENTS

| | | | |
|---|---|---|---|
| 2,268,640 | 1/1942 | Brown | 343/819 |
| 2,703,840 | 3/1955 | Carmichael | 343/815 |
| 2,789,286 | 4/1957 | Marshall | 343/815 |
| 2,799,018 | 7/1957 | Leitner et al. | 343/815 |
| 2,872,681 | 2/1959 | Kearse | 343/833 |
| 2,897,497 | 3/1959 | Finneburgh, Jr. | 343/819 |
| 3,466,655 | 9/1969 | Mayes et al. | 343/815 |
| 3,500,426 | 10/1970 | Wells | 343/819 |
| 4,700,197 | 10/1987 | Milne | 343/837 |
| 4,812,855 | 3/1989 | Coe et al. | 343/815 |
| 4,860,020 | 8/1989 | Wong et al. | 343/826 |
| 5,012,256 | 4/1991 | Maddocks | 343/815 |
| 5,231,412 | 7/1993 | Eberhardt et al. | 343/790 |

*Primary Examiner*—Donald T. Hajec

*Assistant Examiner*—Tan Ho

[57] ABSTRACT

A multiple-frequency monopole or dipole antenna or antenna element that exhibits resonance at multiple arbitrary predetermined frequencies at a single feedpoint includes a driven conductor operative on a first arbitrary predetermined frequency and including a feedpoint. A number n of additional non-driven conductors, wherein n is at least one, resonant at respective n arbitrary predetermined frequencies different from the first frequency are disposed in substantially parallel spaced relationship at a predetermined spacing to electromagnetically couple the driven and non-driven conductors and produce a non-reactive impedance at the feedpoint at the first and at each n additional frequency. Preferably, the predetermined spacing of the driven and non-driven conductors is determined according to the equation:

$$d_{1n}=10^{[0.54Log(D/4)]}\times\frac{Z_0+35.5}{109}\times[1+e^{-[(((F_n/F_1)-1.1)\times 11.3)+0.1]}]$$

where $d_{1n}$ is the spacing on centers between the driven and non-driven conductors, expressed in wavelengths at the n frequency, D is the diameter of the driven and non-driven conductors, expressed in wavelengths at the n frequency, $Z_0$ is the desired impedance at the n frequency when the antenna element is a dipole, or twice the desired impedance when the antenna element is a monopole, $F_1$ is the resonant frequency of the driven conductor, and $F_n$ is the resonant frequency of the n non-driven conductor.

3 Claims, 15 Drawing Sheets

METHOD OF CONSTRUCTING MULTIPLE-FREQUENCY DIPOLE OR MONOPOLE ANTENNA ELEMENTS USING CLOSELY-COUPLED RESONATORS

BACKGROUND OF THE INVENTION

1. Field of the Invention

The present invention relates to antennas, and more particularly pertains to antennas adapted for use in radio and T.V. application for sending or receiving signals on a plurality of different frequencies.

2. Description of the Prior Art

Prior art antennas known as Sleeve Dipole and Open-Sleeve Dipole utilize coupling between nearby parallel conductors to achieve a non-reactive feedpoint at a second frequency. Those conventional types of antennas are substantially different from antennas pursuant to the present invention. The Sleeve Dipole antenna requires a tubular conductor surrounding a fed dipole or monopole, while the Open-Sleeve Dipole replaces that tubular conductor with two conductors placed on either side of the fed dipole. In known applications, both Sleeve Dipole and Open-Sleeve Dipole antennas operate on two frequencies, the second frequency being a multiple of two of the first frequency. Antennas pursuant to the present invention can be used to obtain operation on two, three, four and more arbitrary frequencies, rather than a specific 2:1 ratio, using only a single additional conductor for each additional frequency.

SUMMARY OF THE INVENTION

The present invention utilizes the principle of controlled coupling between nearby conductors to obtain an antenna, or an element used within an antenna array, that exhibits resonance at multiple frequencies at a single feedpoint. The principle can be described broadly as follows, in a discussion which applies equally to both dipole and monopole cases.

Given a dipole that is resonant on some frequency F1; it will have a non-reactive feedpoint of approximately 72 ohms at that frequency. Or, an equivalent monopole fed against ground will have a non-reactive feedpoint impedance of approximately 36 ohms.

If a conductor that is resonant at some different frequency, F2, is brought near the above dipole, without any direct connection, it is well known that they will experience interaction according to the principles of mutual electromagnetic coupling. As the second conductor approaches the first dipole, the coupling increases.

The present invention discloses a method of constructing an antenna by determining a particular distance between the conductors where the coupling is optimum, and the feedpoint of the first dipole exhibits a non-reactive impedance at both F1 and F2.

The present invention discloses a method which can be used to construct dipole or monopole antennas, or elements of an antenna array, which have dipole- or monopole-like behavior at multiple frequencies. The multiple frequency operation is achieved without the use of reactive components or large structures. Rather, a series of closely-spaced parallel conductors, with no direct electrical interconnection, is used to achieve the desired performance.

The present invention discloses specific examples of both monopole and dipole antennas operational from two to seven frequencies. Each example antenna includes a driven element operative on one frequency, plus resonators for each additional frequency.

Particularly preferred embodiments of the invention disclose a multiple-frequency monopole or dipole antenna or antenna element that exhibits resonance at multiple arbitrary predetermined frequencies at a single feedpoint includes a driven conductor operative on a first arbitrary predetermined frequency and including a feedpoint. A number n of additional non-driven conductors, wherein n is at least one, resonant at respective n arbitrary predetermined frequencies different from the first frequency are disposed in substantially parallel spaced relationship at a predetermined spacing to electromagnetically couple the driven and non-driven conductors and produce a non-reactive impedance at the feedpoint at the first and at each n additional frequency. Preferably, the predetermined spacing of the driven and non-driven conductors is determined according to the equation:

$$d_{1n}=10^{[0.54Log(D/4)]}\times\frac{Z_0+35.5}{109}\times[1+e^{-[(((F_n/F_1)-1.1)\times 11.3)+0.1]}]$$

where $d_{1n}$ is the spacing on centers between the driven and non-driven conductors, expressed in wavelengths at the n frequency, D is the diameter of the driven and non-driven conductors, expressed in wavelengths at the n frequency, $Z_0$ is the desired impedance at the n frequency, when the antenna element is a dipole, or twice the desired impedance when the antenna element is a monopole, $F_1$ is the frequency of the driven dipole or monopole, and $F_n$ is the frequency of the n non-driven conductor.

DETAILED DESCRIPTION OF THE PREFERRED EMBODIMENT(S)

Figure 1:
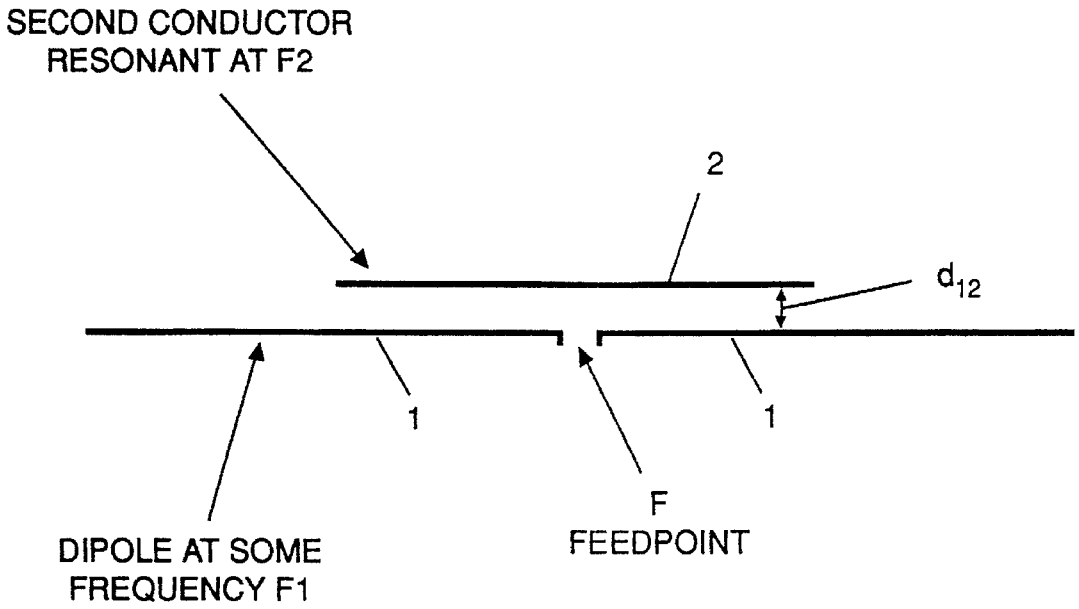
FIG. 1 illustrates a dipole antenna according to the present invention operative on two different frequencies.
Figure 19:
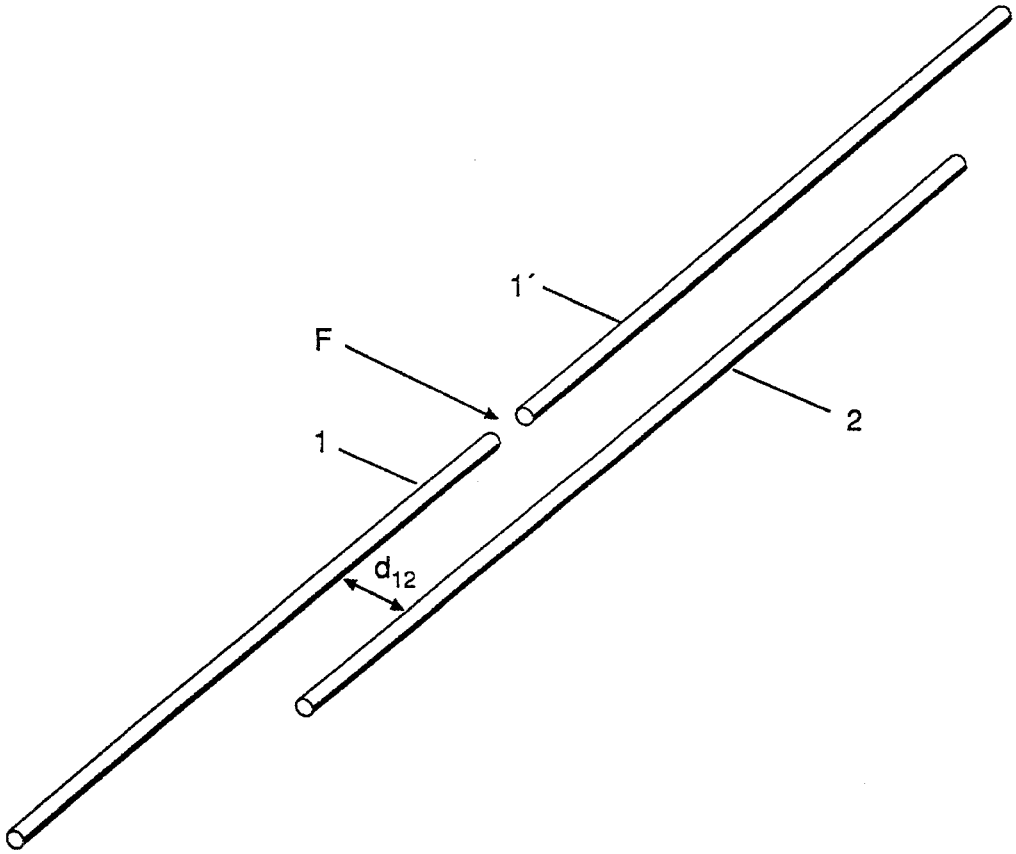
FIG. 19 is a perspective view illustrating a two-frequency dipole antenna according to the present invention.
Figure 20:
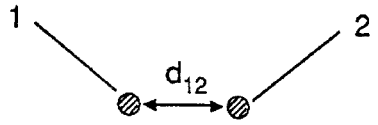
FIG. 20 is an end view illustrating the two-frequency dipole antenna of FIG. 19.

With reference now to the drawings in particular to FIG. 1, FIG. 19, and FIG. 20, a two-frequency dipole antenna system according to the present invention will now be described. The dipole antenna system includes a driven dipole including conductors 1, 1' driven at a feedpoint F. A second conductor 2 is positioned in parallel relation to collinear dipole elements 1, 1' at a distance $d_{12}$. The dipole 1, 1' is resonant at a first frequency F1 and the parallel conductor 2 is resonant at a different frequency F2.

Figure 2:
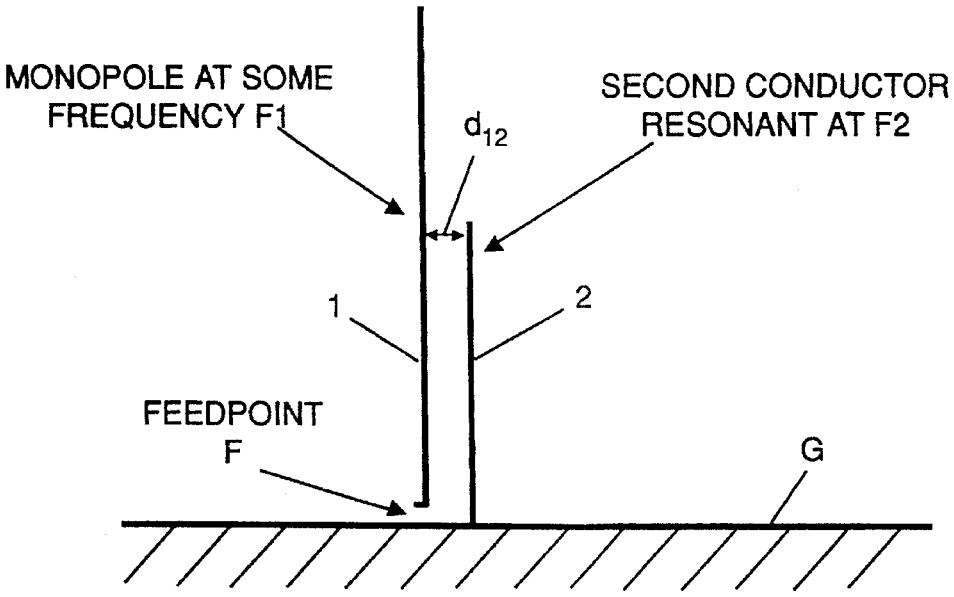
FIG. 2 illustrates an monopole antenna according to the present invention operative on two different frequencies.
Figure 7:
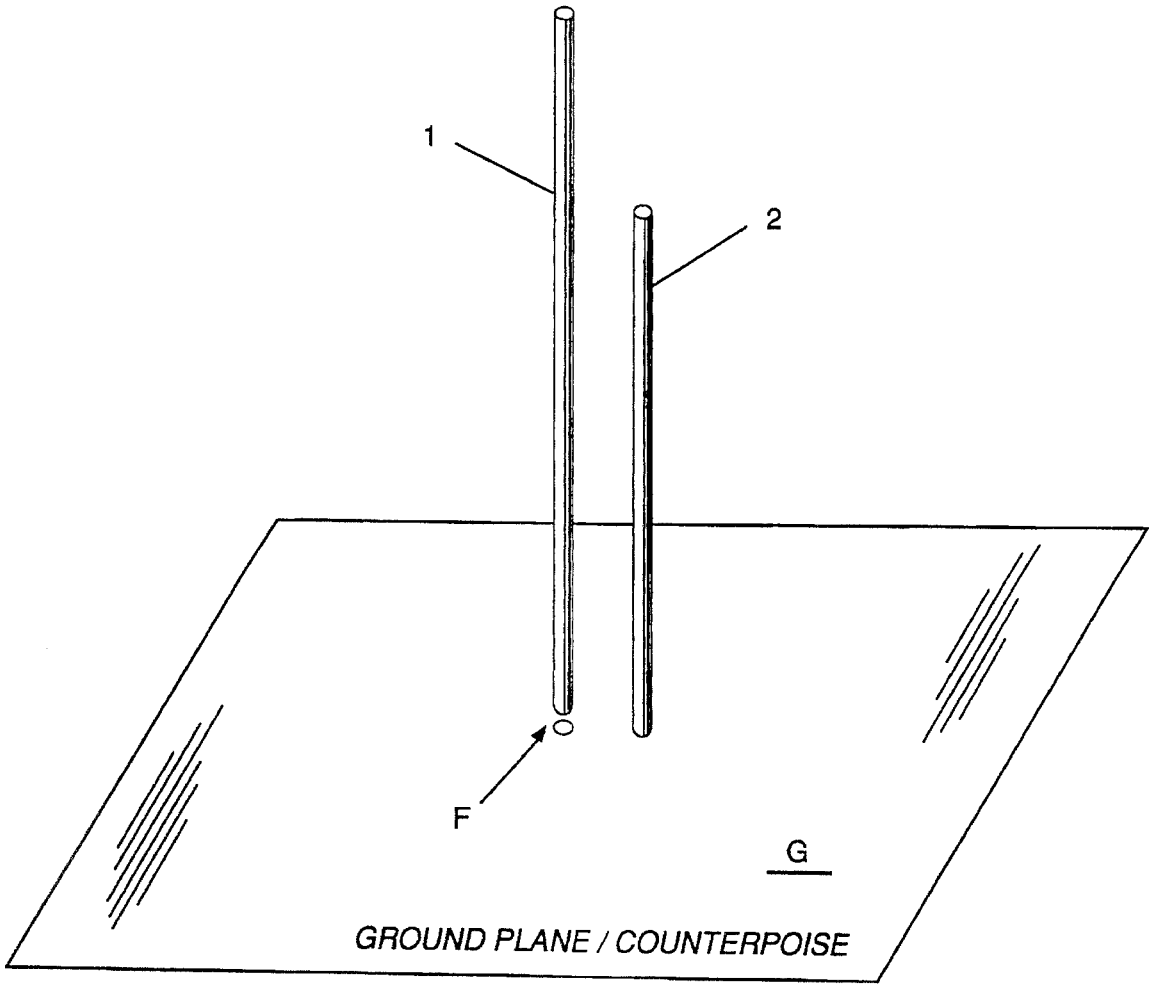
FIG. 7 is a perspective view illustrating a two-frequency monopole antenna according to the present invention.
Figure 8:
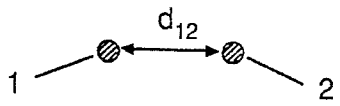
FIG. 8 is a top plan view of the two-frequency monopole antenna of FIG. 7.

FIG. 2, 7, and 8 illustrate a monopole antenna constructed according to the present invention including a monopole fed at a feedpoint F at a frequency F1 and a second conductor 2 resonant at a frequency F2 and connected to a ground plane G.

In both the monopole and dipole cases, the required distance $d_{12}$ between conductors is a function of the desired feedpoint impedance at the additional frequency, the diameter of the conductors, and the ratio of frequencies F1 and F2. For the specific case of a two-frequency system, in free space, using conductors of equal diameters, the required spacing can be computed using the following relationship:

$$d_{12}=10^{[0.54Log(D/4)]}\times\frac{Z_0+35.5}{109}\times[1+e^{-[(((F_2/F_1)-1.1)\times 11.3)+0.1]}]$$

where, $d_{12}$ is the spacing on centers between the dipole and the additional conductor, expressed in wavelengths at F2.

D is the diameter of the dipole and the additional conductor, expressed in wavelengths at F2.

$Z_0$ is the desired impedance at F2.

The above equation is an approximation that is valid for D between 0.00001 wavelength and 0.01 wavelength, within 3 percent for $Z_0$ from 50 ohms to 150 ohms, and within 10 percent for $Z_0$ between 20 and 50 ohms, for F2/F1 ratios of 1.1 and greater. The relationship is defined in terms of wavelength, as it is well-known that antennas may accurately be scaled with regard to physical dimensions versus wavelength.

The two-frequency system is used for illustration only. Additional conductors can be placed in parallel with the first dipole, at the appropriate distances, to make a system for 2, 3, 4, 5, 6, 7 and possibly more frequencies. The method has been verified for seven frequencies, but a practical limitation for the number of additional conductors is reached when interactions between neighboring conductors disturb the desired coupling between each conductor and the main driven dipole.

The lengths of the dipole and additional conductors are nominally one-quarter wavelength in the case of the monopole, and one-half wavelength in the case of the dipole. As is well known, the actual length of a simple monopole or dipole that exhibits a non-reactive impedance is less than a free space one-quarter or one-half wavelength, and varies with conductor diameter. The graph in FIG. 3 shows the reduction in length versus conductor diameter.

Figure 3:
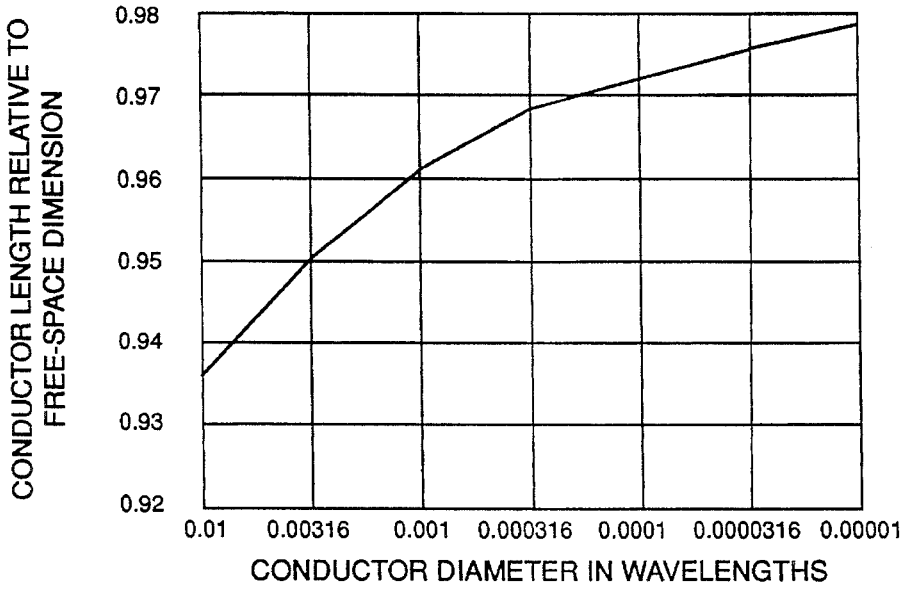
FIG. 3 depicts a graph that illustrates the effect of conductor diameter on the resonant length of a one-half wavelength dipole or a one-quarter wavelength monopole. The factor by which a conductor is shortened relative the free-space length is used to determine the length of the driven dipole or monopole and each of the additional conductors.

An antenna constructed using the method described here requires conductor lengths that are longer than predicted by the graph in FIG. 3. The additional length represents an additional inductance that is required to compensate for the capacitance between the conductors that make up the system. Because the length is a function of capacitance, the effect is greatest when the additional conductor has the greatest length, which is at frequency ratios of 2.0 or less, where the length of the additional conductor is one-half or more of the length of the dipole or monopole. The effect also increases with conductor diameter, and as the number of additional conductors increases.

For a two-frequency antenna, the maximum variation occurs at the relatively large conductor diameter of 0.01 wavelength. At this dimension, the required increase is 1.6 percent, decreasing with conductor size to become nearly insignificant (0.2 percent or less) at diameters less than 0.0001 wavelength. The additional effect caused by a larger system of 3, 4 or more frequencies is an additional 1.0 percent when 0.001 wavelength diameter conductors are used. These small changes are readily identified by adjustment of the antenna system, or by careful and accurate modeling.

An exceptional circumstance for this principle exists when the ratio of the resonant frequencies of the first dipole and the additional conductor is approximately 1:3. In this case, the portion of the structure occupied by the two conductors becomes a one quarter-wavelength transmission line section in the case of a monopole, or two one-quarter wavelength sections in the case of a dipole, one on either side of the central feed point F. The system has a non-reactive impedance at the second frequency and is a useful antenna, however, the currents in the various portions of the structure create a radiation pattern that differs considerably from a simple dipole.

Also in this case, the spacing between conductors must be greater than the predicted distance, according to the following explanation: When an additional conductor is introduced according to this method, the impedance observed at the feedpoint is a parallel combination of the dipole's own impedance and that caused by the additional conductor. Normally, a dipole exhibits a very high impedance at frequencies far removed from its resonant frequency, and the system impedance is almost entirely determined by the effect of the additional conductor. However, at a multiple of three times its resonant frequency, a dipole has an additional resonance and an impedance which, although a higher value than at its primary frequency of resonance, is low enough to have significant effect on the system impedance. In order for the resulting feedpoint impedance to appear dipole-like, the impedance caused by the additional conductor must be higher than usual, which requires a greater than typical spacing.

EXAMPLES

The instant invention describes a general application of the above principle. Specific examples of its implementation are illustrated in the drawings and described below.

EXAMPLE 1

Figure 4:
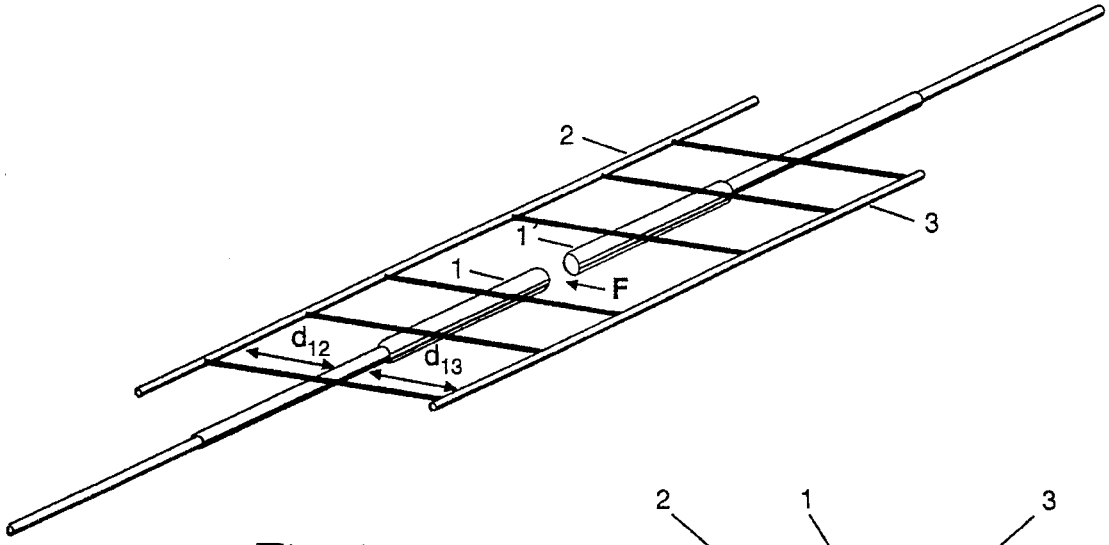
FIG. 4 illustrates a three-frequency dipole antenna according to the present invention constructed of aluminum tubing.
Figure 4A:
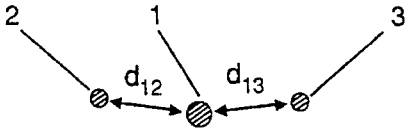
FIG. 4A is a top plan view illustrating the three-frequency dipole antenna of FIG. 4.

A three-frequency dipole for the 10.1–10.15, 18.068–18.168, and 24.89–24.99 MHz bands is shown in FIGS. 4 and 4A.

Figure 5:
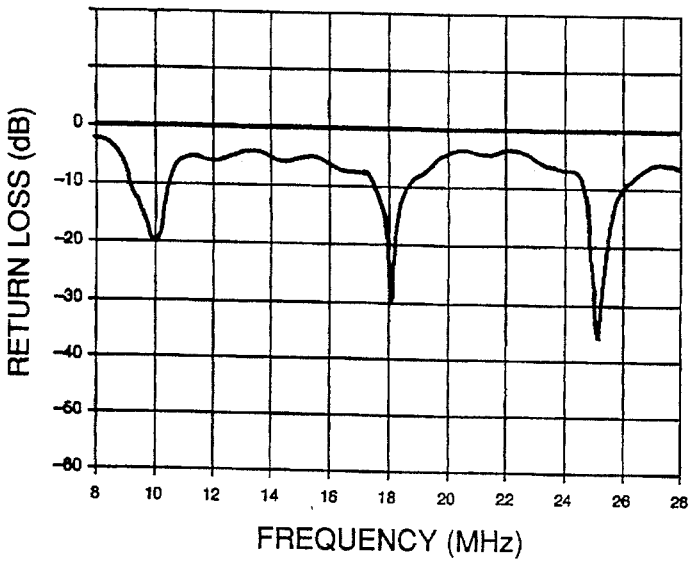
FIG. 5 illustrates an oscilloscope trace of the swept measurement of return loss for the three-frequency dipole antenna shown in FIG. 4.

This antenna was constructed from aluminum tubing. The fed dipole 1, 1' consists of tubing with diameter ranging from 1.25 to 0.5 inches (3.17 to 1.27 cm) in diameter. The closely-coupled additional conductors 2 and 3 are 0.75 inches (1.9 cm) in diameter. Based on the information described previously, spacing was selected to be 7.0 inches (17.8 cm) center-to-center between each additional conductor 2 and 3 and the main dipole 1, 1'. The center of the three conductors is the driven dipole 1, 1' and the two higher-frequency conductors 2 and 3 are supported on insulating spacers which hold them at the required distance from the driven dipole 1, 1'. The spacings were selected to achieve a feedpoint impedance close to 50 ohms at the frequencies of the additional conductors when the antenna was placed at a test height of 50 feet (15.2 m) above ground. FIG. 5 illustrates an oscilloscope trace of the reflection coefficient measurement for a swept frequency of 8–28 MHz of the antenna shown in FIG. 4. The non-reactive impedance at the three desired frequencies 10.1, 18.1, and 24.9 Mhz is shown clearly by the dips in reflection coefficient. Note the optimum matching at the frequencies of the two additional closely-coupled resonators 2 and 3; with return loss better than 30 dB. This measurement was made in a 50-ohm system.

EXAMPLE 2

Figure 6:
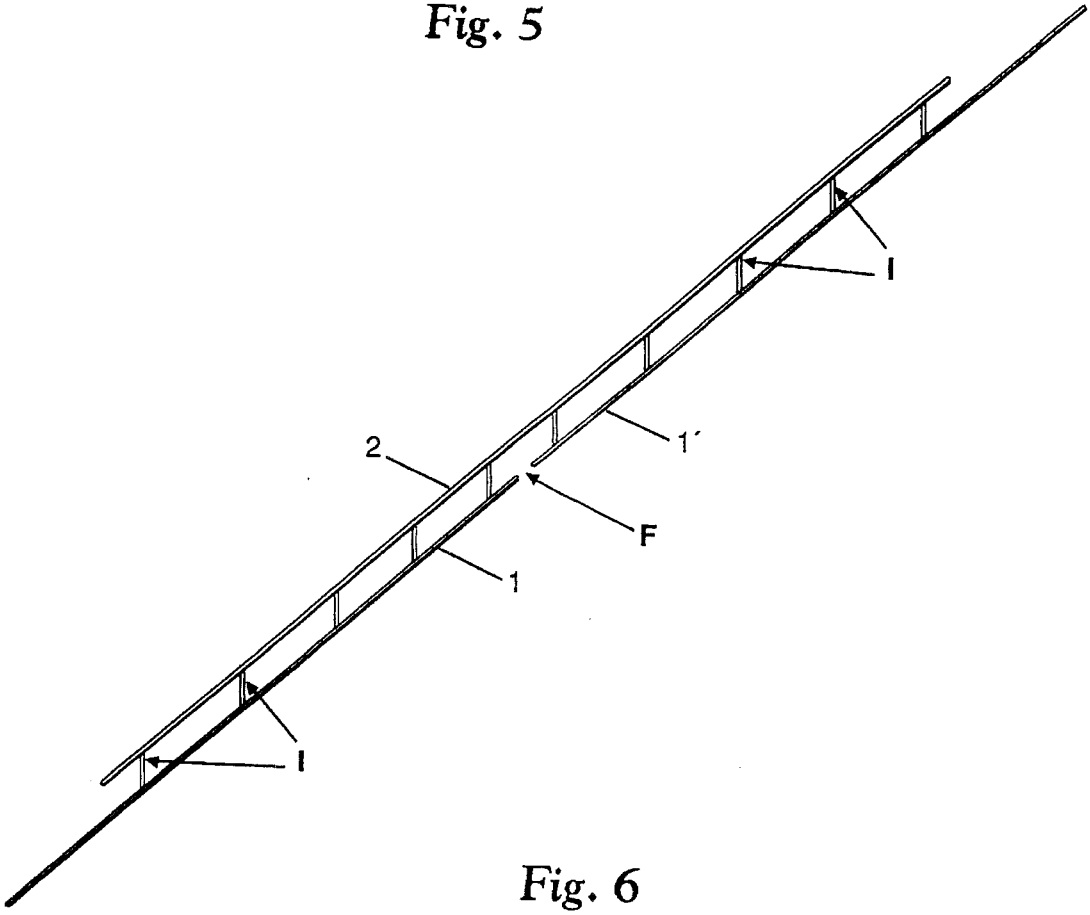
FIG. 6 illustrates a two-frequency monopole antenna according to the present invention using wire construction.

A two-frequency dipole for 18.1 and 24.9 MHz is illustrated in FIG. 6. This antenna was constructed to test the applicability of the principle of the present invention to wire conductors, which are much smaller in diameter than the aluminum tubing used in Example 1. #12 AWG (2 mm) copper was used for the conductors 1, 2, with spacing set at $d_{12}$=2.0 inches (5.1 cm). Using this spacing, a feedpoint impedance of 55 ohms was predicted at the initial test height of 30 feet (9.14 m) above ground. The two wire conductors 1, 2 are held in position by plastic insulators I. Measurements on this antenna showed a typical dipole impedance at the lower (driven dipole) frequency of 18.1 MHz, and the expected resonance at the higher frequency of 24.9 MHz, as indicated by a non-reactive feedpoint impedance. Experiments were conducted with this antenna to observe the effects of height above ground. At both frequencies, the variation in impedance versus height showed a pattern very similar to published data on an ordinary dipole: changes in resonant frequency and a swing in feedpoint impedance as the height increases from near zero to over one wavelength.

Applications Of The Invention

Using the principles of the present invention, dipole and monopole antenna elements and arrays may be constructed to operate on multiple frequencies. This is a valuable feature for communications systems that must operate on a number of different frequencies, or when a single antenna is to be switched among equipment operating on different frequencies. For example, the Amateur Radio Service uses frequencies allocated on a number of relatively narrow bands throughout the radio spectrum. Other services with multiple frequency operations include international shortwave broadcasting, air traffic control, broadcast radio and television, mobile radio services, satellite communications systems, and various military communications and countermeasures systems.

Existing methods which accomplish multi-frequency operation often involve reactive "traps" or decoupling networks, or have unusual shapes and large occupied volumes, e.g., the fan dipole and the log periodic. They may also employ external networks to match the antenna to a standard system impedance. Losses in reactively-tuned antennas and matching networks can be significant, and other multiband configurations may not present controlled impedances. Systems built using the principle presented here can be directly matched to common transmission line impedances, and do not have lossy reactive components. A dipole or monopole element using this principle may be incorporated into a larger array, in the same manner as a simple dipole or monopole. Yagi-Uda arrays, phased arrays, and curtain arrays are typical examples of arrays of dipole or monopole elements.

SUMMARY

Computer Analysis And Verification With Test Antennas

Characteristics of example antennas according to the present invention were determined using extensive computer modeling, with several test antennas constructed to verify the accuracy of the modeling. The computer program used was ELNEC, authored by Roy Lewallen, P. 0. Box 6658, Beaverton, Oreg. 97007. Lewallen's ELNEC program uses the same computation algorithm as MININEC3, developed by the Naval Ocean Systems Center, but with enhancements that improve ease of use, and a correction factor that improves accuracy for closely-spaced wires, as are used in this family of antennas. MININEC3 is a well-known program for the analysis of antennas constructed of thin wires or cylindrical conductors that have a large length-to-diameter ration. MININEC3 is a restricted version of the Numerical Electromagnetics Code (NEC), which is universally accepted as a highly accurate computer modeling tool for electromagnetic field behavior. ELNEC, MININEC3, and NEC all use the method-of-moments technique in their calculations.

Figure 21:
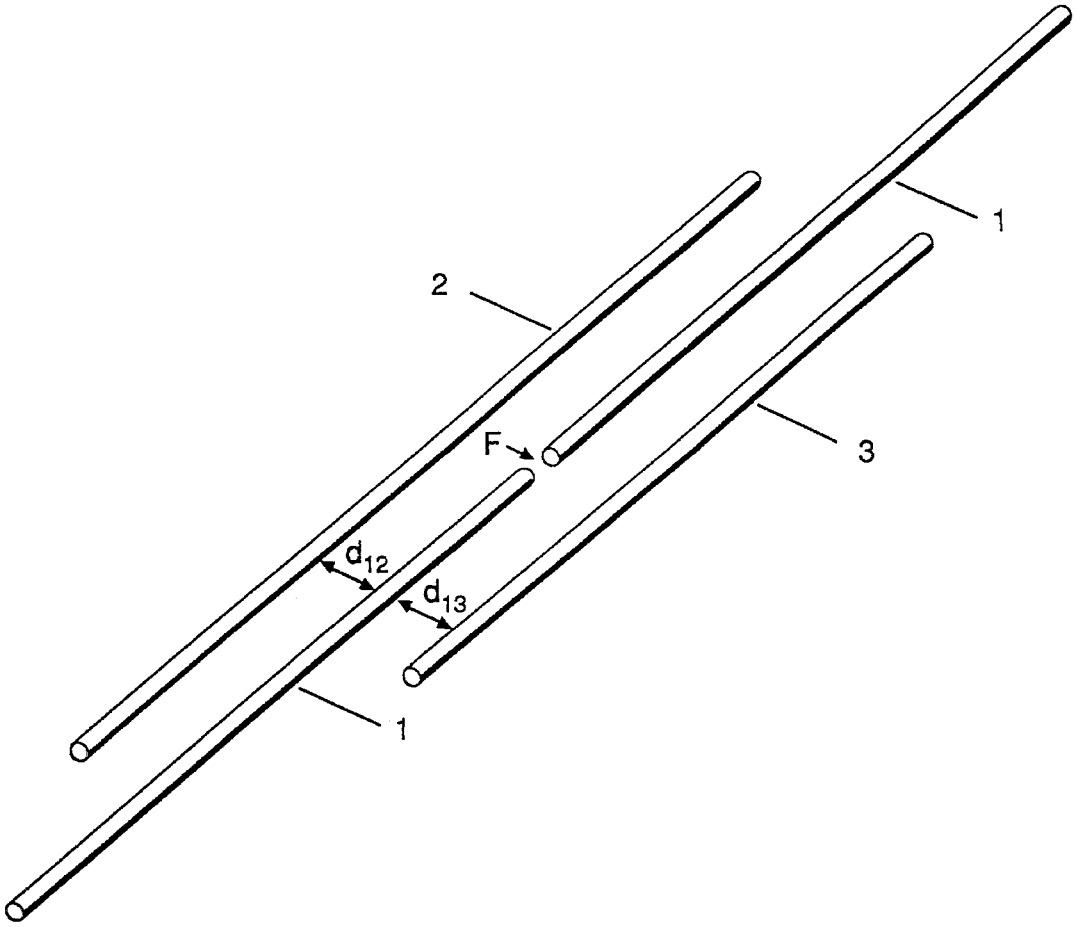
FIG. 21 is a perspective view illustrating a three-frequency dipole antenna according to the present invention.
Figure 22:
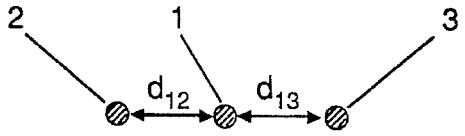
FIG. 22 is an end view illustrating the three-frequency dipole antenna of FIG. 21.

Several test antennas were constructed to verify the accuracy of the computer models. The first test antenna was a three-frequency dipole for 14.0, 21.0 and 28.0 MHz, constructed from aluminum tubing, as shown in FIG. 3, 21, and 22. The main dipole 1, 1' was built of telescoping sections varying from 1.5 inches (3.8 cm) to 0.75 inch (1.9 cm) diameter. The additional resonators 2 and 3 were built with #12 AWG (2 mm) wire, then replaced with 0.75 inch (1.9 cm) diameter tubing. The length and spacing of the conductors was as follows: $L_1$=17.125 feet (5.22 m), $L_1$'=17.125 feet (5.22 m), $L_2$=22.43 feet (6.84 m), $L_3$=14.3 feet (4.36 m), $d_{12}$=7 inches (17.8 cm), and $d_{13}$=6 inches (15.25 cm). Impedance measurements were made using a General Radio 1606B RF Impedance Bridge, and swept return loss measurements were made with a spectrum analyzer, tracking signal generator and an ANZAC RB-1-50 HF Return Loss Bridge. Within the accuracy of the instruments used, and within the limits of uncertainty regarding the ground conductivity at the site, the as-built antenna performed as predicted by the ELNEC program, both in resonant frequencies, and the impedance at each frequency.

Figure 25:
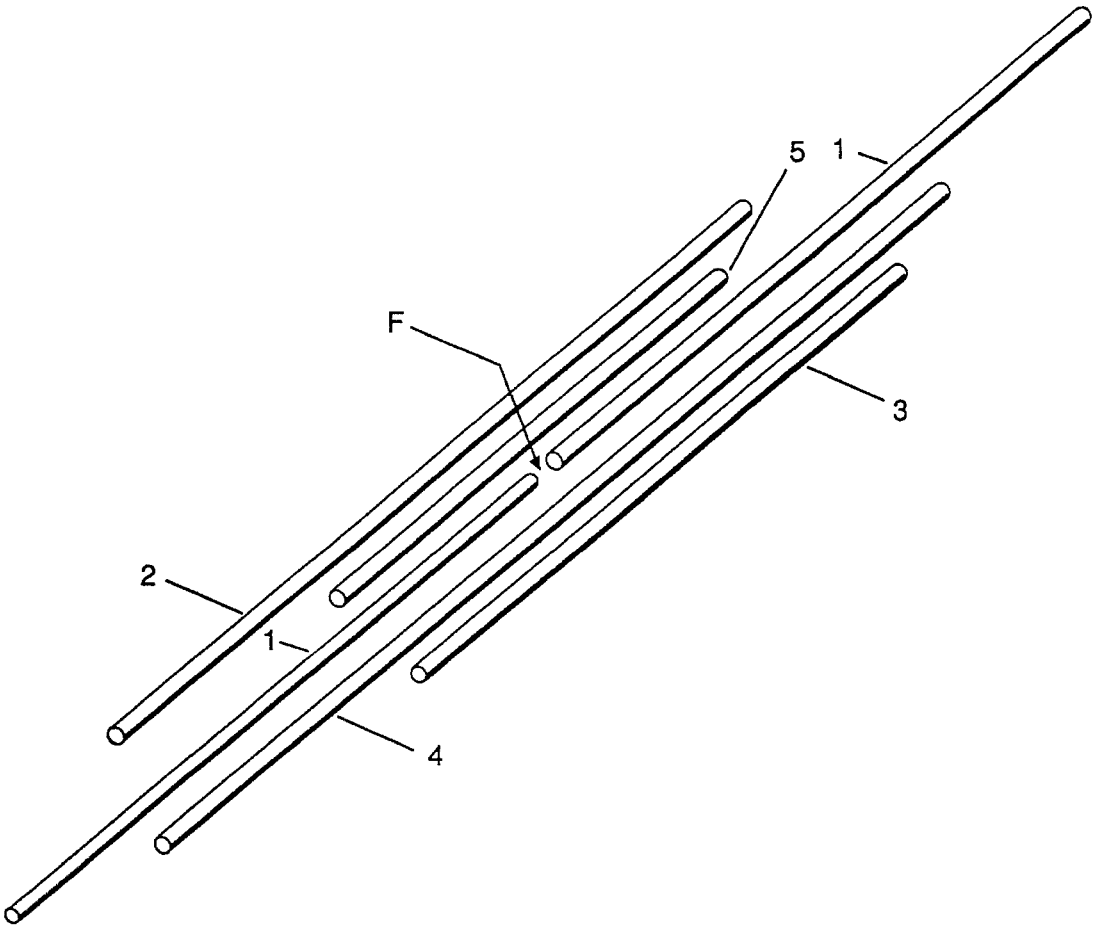
FIG. 25 is a perspective view illustrating a five-frequency dipole antenna according to the present invention.
Figure 26:
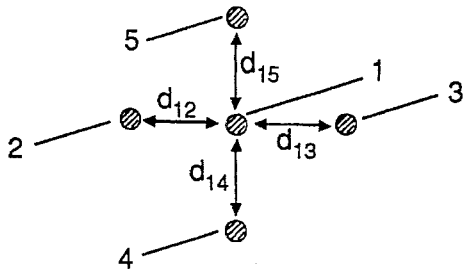
FIG. 26 is an end view illustrating the five-frequency dipole antenna of FIG. 25.

The above three-frequency dipole was modified for five-frequency operation by adding two more additional resonators, as shown in FIGS. 25 and 26. This configuration generally performed as predicted by the computer model, particularly in resonant frequency. However, it exhibited sufficient variation in impedance from the computer model to warrant additional study. It was finally decided that the accuracy of construction and the uncertainty of the local ground conductivity were probable causes for the modest deviation from the predicted performance.

To test the model with different diameter conductors and at different frequencies, two-frequency antennas were constructed from #12 AWG (2 mm) wire, as shown in FIG. 5. One was designed for 18.1 and 24.9 MHz the other for 28.0 and 50.0 MHz having conductor lengths and spacing of $L_1$=26.7 feet (8.14 m), $L_2$=19.25 feet (5.87 m), and $d_{12}$=2.0 inches (5.1 cm). Both demonstrated characteristics predicted by the computer model, with particular attention paid to differences from the larger tubing construction. As predicted by the computer model, the wire antennas exhibited a narrower VSWR bandwidth and a greater sensitivity to impedance variations versus height above ground.

A further test antenna was a three-frequency dipole for 10.1, 18.1 and 24.9 MHz, constructed from tubing, as shown in FIG. 3. This test antenna was the most precisely modeled and most carefully constructed, and its performance followed the computer model as closely as it was possible to measure.

Figure 9:
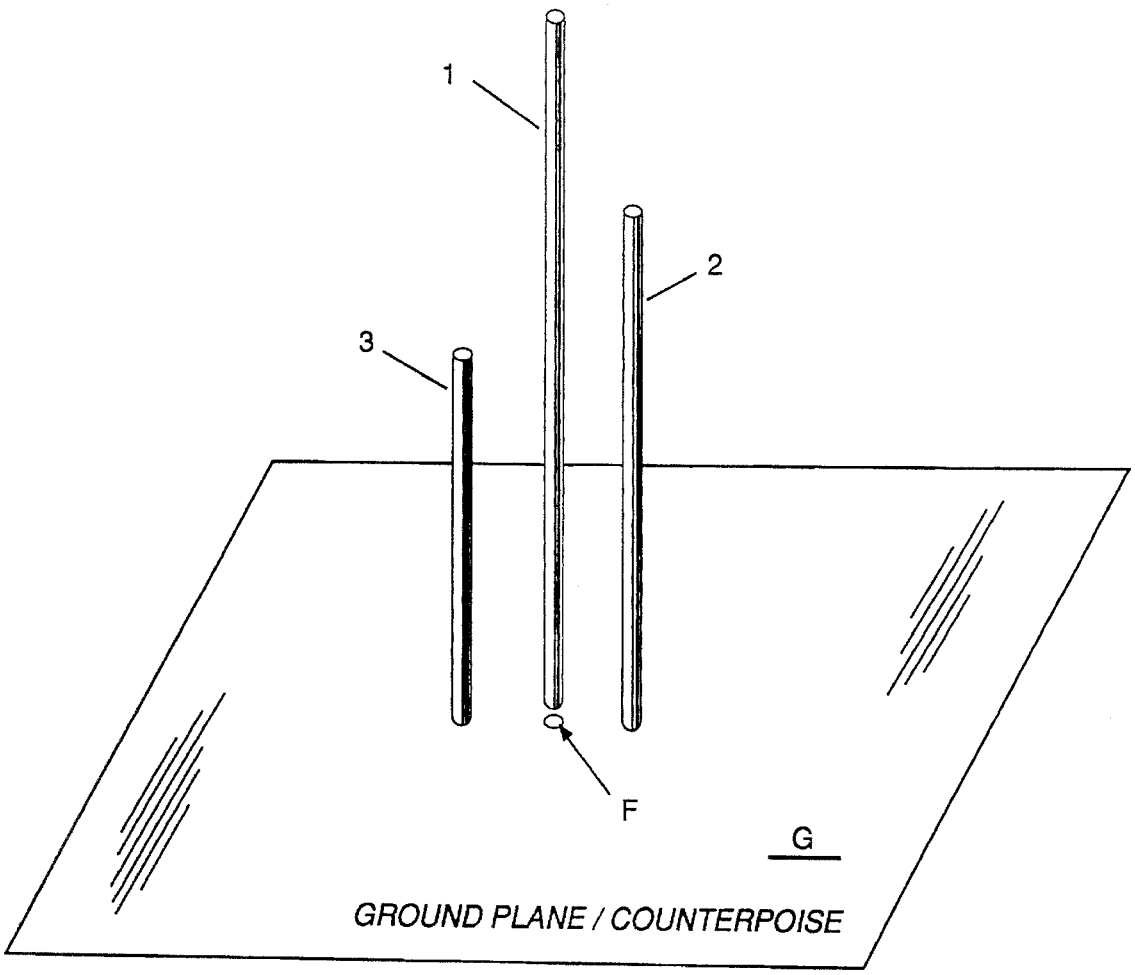
FIG. 9 is a perspective view illustrating a three-frequency monopole antenna according to the present invention.
Figure 10:
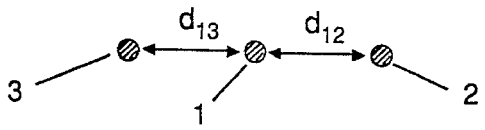
FIG. 10 is a top plan view illustrating a three-frequency monopole antenna of FIG. 9.

One monopole antenna was constructed, a three-frequency version for 14.0, 21.0 and 28.0 MHz, as shown in FIGS. 9 and 10, having conductor lengths and spacings of $L_1$=17.0 feet (5.18 m), $L_2$=11.3 feet (3.45 m), $L_3$=8.53 feet (2.6 m), $d_{12}$=7 inches (17.8 cm), and $d_{13}$=6 inches (15.25 cm). Performance agreed with the computer model within the limits of accuracy noted for the dipole test antennas.

The test antennas are included as examples for the various configurations contained in the claims. The element diameters, spacing and lengths are given in those descriptions.

Examples And Notes For The Various Configurations

Two-Frequency Dipole

Two-frequency dipoles were analyzed for several different frequencies, frequency ratios between dipole and additional resonator, and conductor sizes. For example, a two-frequency dipole, of the type shown in FIGS. 19 and 20, with a driven dipole at 18.1 MHz and an additional resonator at 24.9 MHz was computer-modeled, then constructed. Using #12 AWG (2 mm) wire conductors, the required spacing $d_{12}$ between the conductors is 2.0 inches (5.1 cm). The length $L_1$+$L_1$, of the 18.1 MHz driven dipole was determined according to the previously described procedure. The 24.9 MHz resonator length $L_2$ was found to follow approximately the same formula.

One configuration of closely-spaced frequencies was computer modeled for an antenna of the type depicted in FIGS. 19 and 20. A driven dipole at 3.5 MHz and an additional resonator at 3.8 MHz were analyzed. The ratio of frequencies is 1.086, a very small difference which was anticipated as having very strong coupling. This was borne out by the computer model, which showed that using #14 AWG (1.6 mm) wire, a spacing $d_{12}$ of approximately 4.0 feet would result in an impedance near 50 ohms at the higher frequency. The driven dipole 1, 1' in this system was found to require 2.5% greater length $L_1$+$L_1$, than a dipole alone, to compensate for the capacitance created by the additional resonator. The additional resonator 2 required very little deviation in length $L_2$ from published half-wave dipole formulae.

Three-Frequency Dipole

The configuration illustrated in FIGS. 20 and 21 was both computer modeled and tested at several different frequencies, frequency ratios and conductor sizes. A summary of the various antennas analyzed and/or tested follows:

An aluminum tubing antenna was built with a driven dipole 1, 1' at 10.1 MHz, plus additional resonators 2 and 3 at 18.1 and 24.9 MHz. The main dipole 1, 1' had an average diameter of 1.125 inches (2.86 cm), and each additional resonator 2 and 3 was 0.75 inch (1.9 cm) in diameter. Equal spacing $d_{12}$=$d_{13}$ of 7 inches (17.8 cm) on centers was used between the main dipole 1, 1' and each additional resonator 2 and 3. Using a test height of 50 feet (15.24 m) above ground, computer modeling predicted that the impedance at the feedpoint F would be approximately 50 ohms at 10.1 MHz, 47 ohms at 18.1 MHz, and close to 50 ohms at 24.9 MHz. VSWR measurement of the antenna verified that the impedance was within three ohms of the predicted values.

A wire dipole for the same frequencies was modeled and constructed. Using #12 AWG (2 mm) wire, the required spacing $d_{12}$, $d_{13}$ for 50 ohm impedance at the frequencies of the two additional resonators was 2.0 inches (5.1 cm) at 18.1 MHz, and 1.75 inches (4.45 cm) at 24.9 MHz. VSWR measurement of this antenna verified that the impedance was within 10 percent of the predicted values.

A dipole for 14.0 MHz, 21.0 MHz and 28.0 MHz was built using tubing conductors. The driven dipole 1, 1' was 1.0 inch (2.54 cm) in diameter and the additional resonators 2 and 3 were 0.75 inch (1.9 cm) in diameter. Equal spacing $d_{12}$ and $d_{13}$ between conductors of 6 inches (15.24 cm) resulted in a VSWR at each frequency of less than 1.15:1 indicating that the impedance was within 15 percent of 50 ohms.

Four-Frequency Dipole

Figure 23:
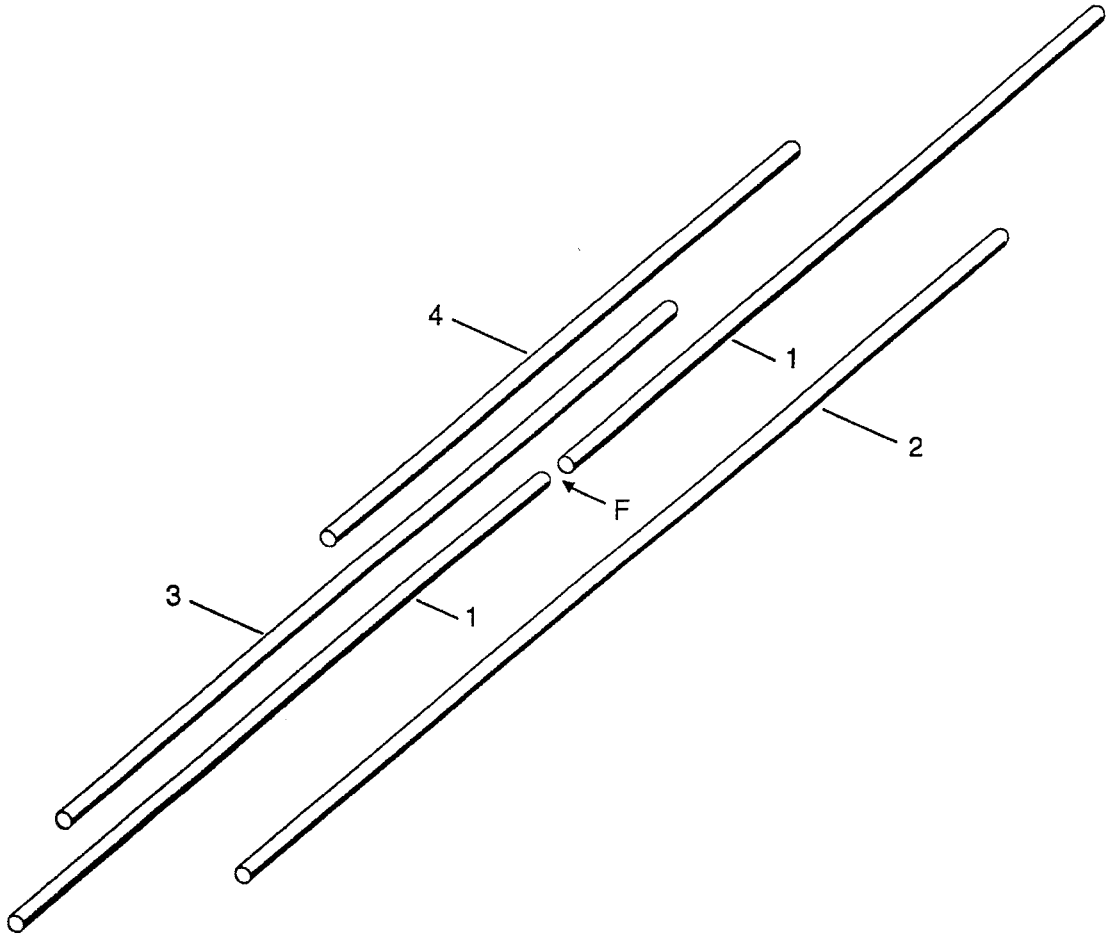
FIG. 23 is a perspective view illustrating a four-frequency dipole antenna according to the present invention.
Figure 24:
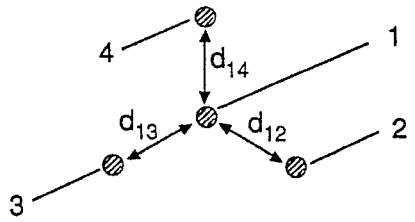
FIG. 24 is an end view illustrating the four-frequency dipole antenna of FIG. 23.

A four-frequency dipole antenna is illustrated in FIGS. 23 and 24. The required spacing $d_{12}$, $d_{13}$, $d_{14}$ from the main dipole 1, 1' does not vary more than one percent as additional resonators beyond two are added to a system. For example, computer modeling was performed to analyze a system which began with a dipole 1, 1' and one additional resonator 2 (two frequencies), then introduced successive resonators 3, 4, 5, 6, and 7 for three, four, five, six and seven frequencies. Resonator lengths L and spacings d for the four-frequency configuration are essentially identical to those for a three-frequency system. The main dipole 1, 1' requires a small increase in length $L_1$+$L_1$, of no more than 0.3% to compensate for the additional capacitance of the larger number of conductors.

Five-Frequency Dipole

The three-frequency dipole noted above for 14.0, 21.0 and 28.0 MHz was adapted for five-frequency operation by adding 18.1 and 24.9 MHz resonators, as shown in FIGS. 25 and 26. The original three-frequency configuration was not changed, offering an opportunity to observe the changes due to the additional resonators. All that was noted was a slight increase in the resonant frequency of the original three frequencies (less than 0.1%). This is consistent with an increase in the capacitance due to the additional conductors. The selected spacing $d_{12}=d_{13}=d_{14}=d_{15}$ of 6 inches (15.2 cm) resulted in an impedance within 15% of 50 ohms at the frequency of each additional resonator 2, 3, 4, and 5. As in all configurations, the main dipole impedance follows closely with predicted impedance of a simple dipole at its frequency of resonance, varying from less than 50 ohms at low heights above ground, to nearly 100 ohms when the height is 0.4 wavelengths at that frequency.

Five-frequency dipoles of the type shown in FIG. 25 and 26 were modeled for two other frequency combinations: 3.5, 3.8, 7.0, 10.1 and 14.0 MHz; and 30, 45, 67, 102 and 153 MHz. Each model confirmed that the required spacing $d_{12}$, $d_{13}$, $d_{14}$, $d_{15}$ between the main dipole 1, 1' and each additional resonator 2, 3, 4, and 5 changed minimally from the two frequency configuration. In the first case, the spacing $d_{14}$ between the 3.5 MHz main dipole 1, 1' and the 3.8 MHz radiator 4 was 48 inches (1.22 m), with 6 inches (15.2 cm) $d_{12}$ to the 7.0 MHz resonator 2, 3 inches (7.6 cm) $d_{13}$ to the 10.1 MHz resonator 3 and 2.4 inches (6.1 cm) $d_{15}$ to the 14.0 MHz radiator 5, all using #12 AWG (2 mm) wire as the conductor. The second model was used to evaluate a dipole with geometric distribution of frequencies over a wide span (nearly 2 octaves). All conductors were modeled at ¼ inch (6.4 mm) diameter, and the spacing $d_{12}$, $d_{13}$, $d_{14}$, $d_{15}$ for all conductors was kept constant at 2.0 inches (5.1 cm). The length L of each conductor was determined by the formula: L (feet)= 477/f (MHz), which is an average value taken from FIG. 3. Variations in length were shown to be between +1% and −2% from that formula. Impedance using the 2.0 inch (5.1 cm) spacing varied from 42 ohms at the lowest frequency to 62 ohms at the highest, which is consistent with the design equation calculation.

Six-Frequency Dipole

Figure 27:
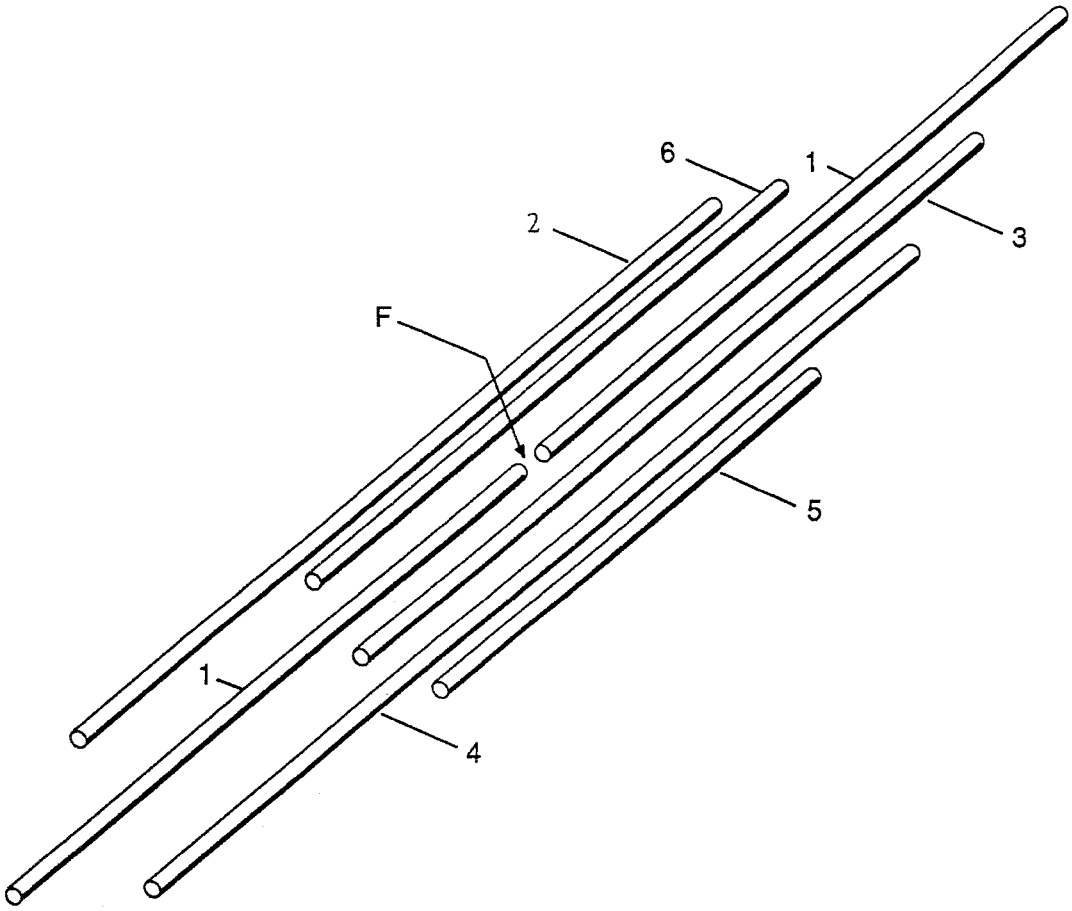
FIG. 27 is a perspective view illustrating a six-frequency dipole antenna according to the present invention.
Figure 28:
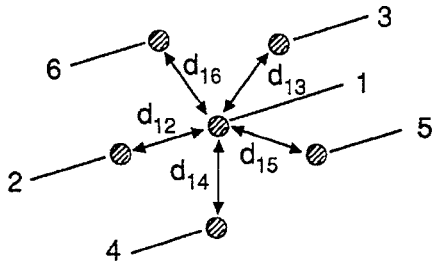
FIG. 28 is an end view illustrating the six-frequency dipole antenna of FIG. 27.

A computer model was analyzed for a six-frequency dipole of the type shown in FIGS. 27 and 28 operating at 14.0, 18.1, 21.0, 24.9, 28.1 and 28.4 MHz. 1.0 inch (2.54 cm) diameter conductors and constant 6.5 inch (16.5 cm) spacing $d_{12}=d_{13}=d_{14}=d_{15}=d_{16}$ was used. It was observed that, as the number of frequencies (and the number of additional resonators) increased, the VSWR bandwidth at each frequency decreased, with the greatest change at the highest frequency of operation. In a five-frequency dipole, the bandwidth reduction at the highest frequency is approximately a factor of three, compared to a simple dipole at that frequency, using the same diameter conductor. While useful performance is still obtained, in some cases a greater bandwidth is desirable. This model showed that two additional resonators could be used to offset the reduced bandwidth of a single resonator. The 28.1 MHz and 28.4 MHz resonators each exhibited approximately 300 kHz bandwidth within 2:1 VSWR or less. As a result, the model verified that adjacent coverage of these two resonators would allow a bandwidth twice that of a single resonator.

Seven-Frequency Dipole

Figure 29:
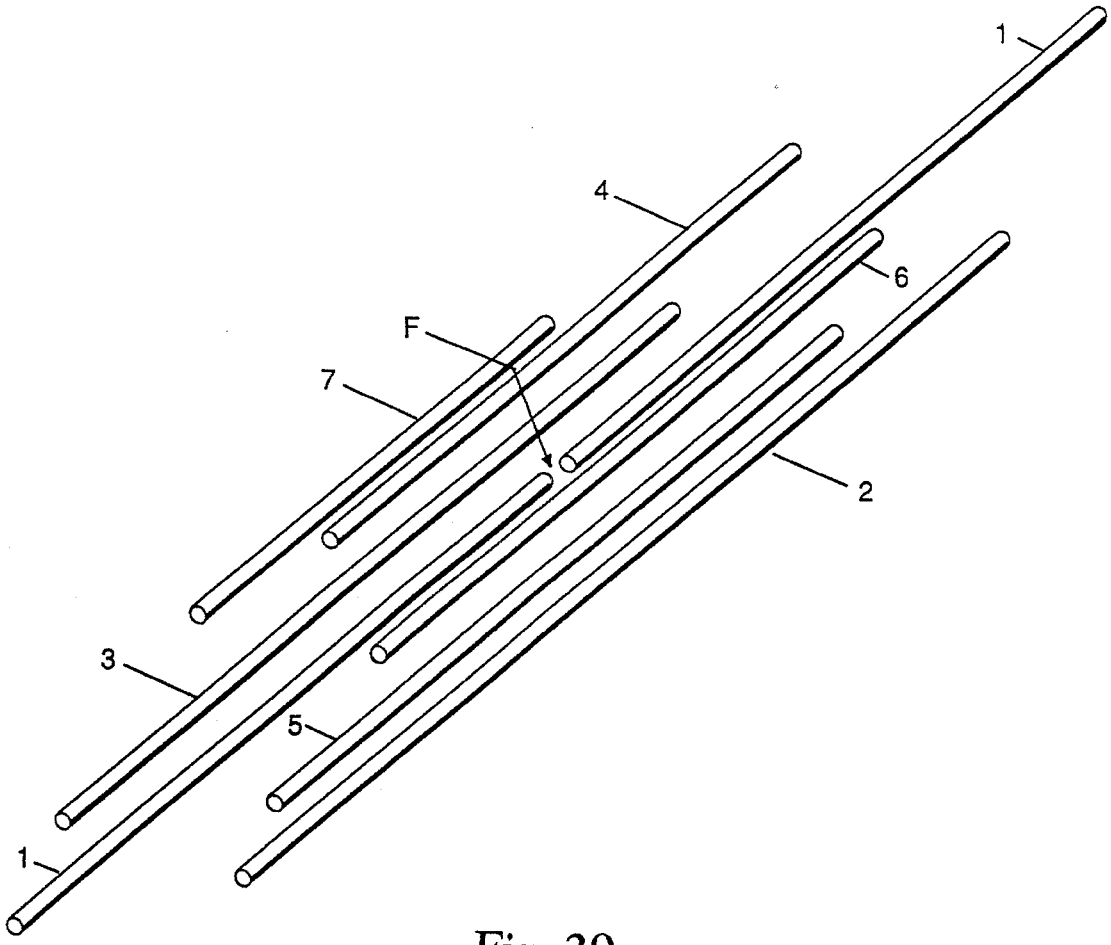
FIG. 29 is a perspective view illustrating a seven-frequency dipole antenna according to the present invention.
Figure 30:
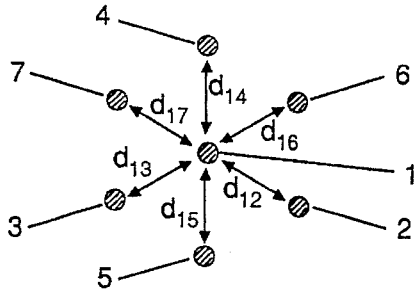
FIG. 30 is an end view illustrating the seven-frequency dipole antenna of FIG. 29.

The largest system modeled was a seven-frequency dipole of the type shown in FIGS. 29 and 30 for 7.0, 10.1, 14.0, 18.1, 21.0, 24.9, and 28.0 MHz. The main dipole 1, 1' and all additional conductors were selected to be 1 inch (2.54 cm) diameter. Spacings $d_{12}$, $d_{13}$, $d_{14}$, $d_{15}$, $d_{16}$, $d_{17}$ were calculated according to the design equation described previously, incorporating all of the described correction factors and adjustments, to present a 50 ohm impedance at the resonant frequency of each additional conductor. Each conductor length L was calculated according to the L=477/f formula. The feedpoint impedance was analyzed at 0.1 MHz intervals between 7.0 and 30 MHz.

The frequencies where a non-reactive impedance occurred were found to be higher than the design frequencies by a factor of 1 to 3 percent. The impedances at resonance were found to be within 6 to 12 percent of the intended 50 ohms, but in all cases, the impedance value was lower than 50 ohms. This suggests that the cumulative effects of the additional conductors cause the design method to become less accurate for this configuration.

It should be noted, however, that the basic principle remained valid for the seven-frequency dipole: a low, non-reactive impedance was present at the resonant frequency of each additional resonator. This suggests that, by experimental adjustment of an antenna as constructed, or through an iterative design process using proven modeling computer programs, a configuration can be achieved that exhibits the desired feedpoint impedance at the desired resonant frequencies.

General Notes On Monopole Configurations

Because a quarter-wavelength monopole, fed against an infinite ground plane G (or a close approximation thereof) is an exact electrical equivalent of a dipole in free space, and because a grounded quarter-wavelength resonator is electrically equivalent to a half-wavelength resonator in free space, the behavior demonstrated by dipole configurations of this antenna design must be duplicated in the monopole configuration. The only difference is that the monopole will exhibit an impedance one-half that of the corresponding dipole, because all of the power is present in one-half the length (one-quarter wavelength instead of one-half wavelength), and the radiation takes place in half-space (e.g., no radiation below ground) instead of free space.

One monopole test antenna of the type shown in FIGS. 9 and 10 was constructed for 14.0, 21.0 and 28.0 MHz to demonstrate this equivalence. Conductor diameter was 1.25 inches (3.18 cm) for the main monopole 1 and 1.0 inches (2.54 cm) for the two additional resonators 2 and 3, which were placed on either side of the main monopole. Equal spacing $d_{12}=d_{13}$ of 7.0 inches (17.8 cm) was used. The monopole was installed over lossy ground, with approximately eight non-resonant radial wires placed on the ground to decrease the losses. The ideal feedpoint F impedance for the main monopole 1, 1' over perfect ground would be 36 ohms at resonance. In this installation, ground losses resulted in a measured impedance of 42 ohms. The impedance at the additional frequencies was approximately 45 ohms, with a design impedance of approximately 40 ohms, based on perfect ground and the chosen spacing from the central monopole. All frequencies showed a noticeable deviation from the design resonant frequency, due to the imperfect ground. This deviation was easily corrected by adjustment of the length L of each conductor to restore resonance at the desired frequencies.

Two-Frequency Monopole

Two-frequency monopole configurations of the type shown in FIGS. 7 and 8 were analyzed with the main monopole frequency fixed at 7.0 MHz (34.0 feet (10.4 m) in length), with six additional frequencies introduced one at a time, and with all conductors fixed at 1.0 inch (2.54 cm) diameter. Distance from the main monopole to the additional resonators was adjusted until the impedance at the second frequency was equal to that at the resonant frequency of the main monopole. With a second frequency of 10.1 MHz, the required spacing $d_{12}$ is 1.0 foot and the length $L_2$ is 23.5 feet. At 14 MHz, the spacing $d_{12}$ is 0.80 foot, with a length $L_2$ of 17.0 feet. At 18.1 MHz, the spacing $d_{12}$ is 0.72 foot, with a length $L_2$ of 13.15 feet. At 21.0 MHz, the spacing $d_{12}$ is 1.25 feet, with a length L2 of 11.333 feet. At 24.9 MHz, the spacing $d_{12}$ is 0.633 foot, with a length $L_2$ of 9.5 feet. At 28.0 MHz, the spacing $d_{12}$ is 0.625 feet, with a length L2 of 8.5 feet. Note that at 21 MHz, the main monopole is very close to ¾ wavelength, where it exhibits a harmonic resonance. The unusually large spacing is required to create a resultant impedance at the feedpoint F that is a combination of both the self-resonant impedance of the monopole 1, and the impedance established by the additional resonator 2. Because this is a unique situation at a frequency ratio of 3-to-1, 21 MHz was not used in later analysis of three through six frequencies, although it was re-introduced for the seven-frequency analysis.

The following analyses were done by placing the additional resonators at the distances and lengths established for the two-frequency case and evaluating the impedance of the system at each frequency. Having established a base line of two-frequency spacings and lengths, this is an equally good indicator of variation from a regular pattern of behavior, compared to adjustment of the lengths and spacings to achieve a specific non-reactive impedance.

Three-Frequency Monopole

In addition to the 7.0 MHz main monopole 1, additional conductors 2 and 3 at frequencies of 14.0 and 24.9 were used in this analysis for antennas of the type shown in FIGS. 9 and 10. At 7.0 MHz, the feedpoint F impedance was within 0.5% of the two-frequency case of 7.0 and 14.0 MHz. At 14.0 MHz, a similar small variation was seen. At 24.9 MHz, the variation in impedance was approximately 1.2%. All of the variations were in the capacitive direction (negative reactance), with a slightly lower resistive component.

Four-Frequency Monopole

Figure 11:
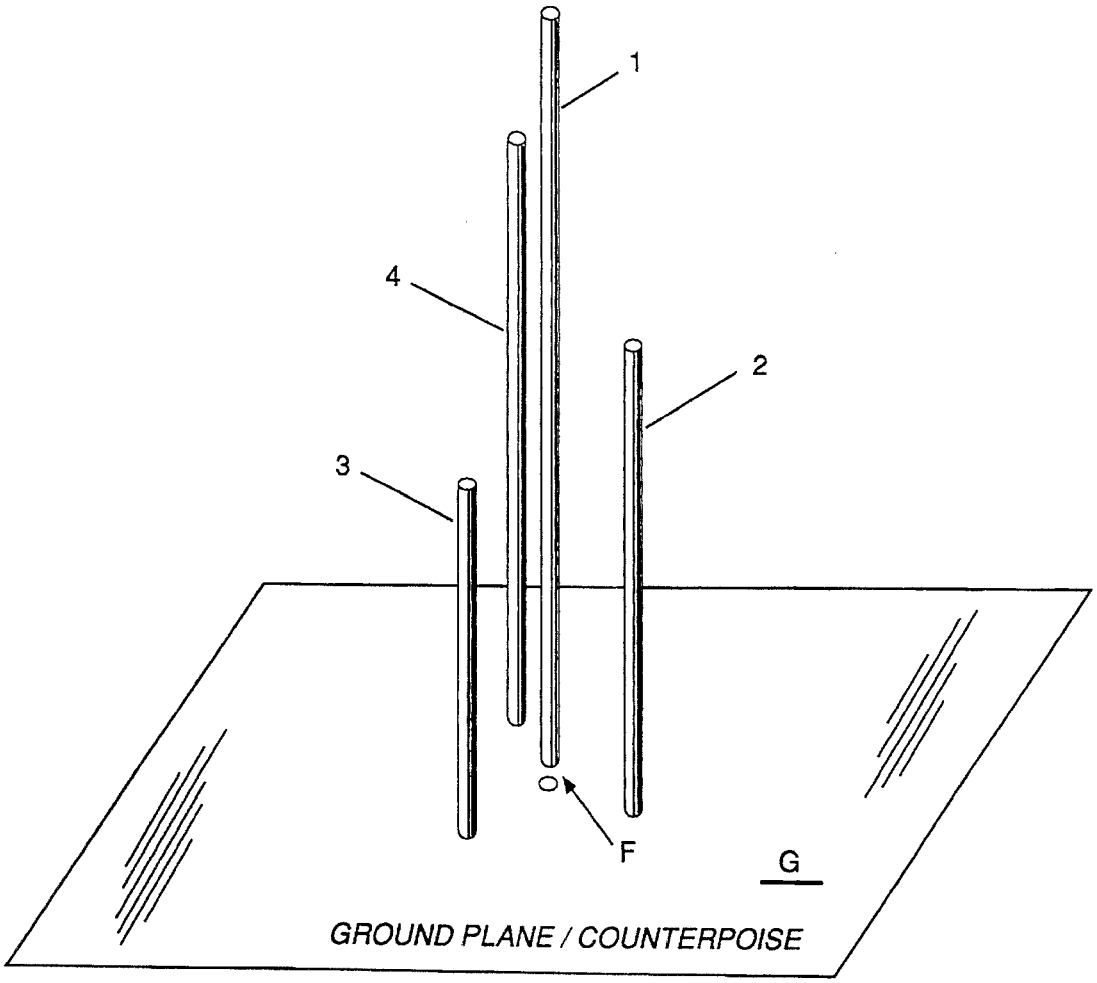
FIG. 11 is a perspective view illustrating a four-frequency monopole antenna according to the present invention.
Figure 12:
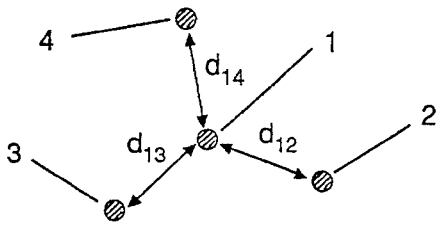
FIG. 12 is a top plan view illustrating a four-frequency monopole antenna of FIG. 11.

For analysis of monopole antennas of the type shown in FIG. 11 and 12, the additional frequency of 10.1 MHz was added to the three-frequency model. At both 7.0 and 14.0 MHz, a small increase in the capacitive reactance was noted, less than 0.7% change from the two-frequency case. At 10.1 MHz, the variation was similar, approximately 0.6% change from the two-frequency base line case. A larger change was observed at 24.9 MHz, where the capacitive reactance increased to about 14 ohms, a net change in impedance of 7 percent.

Five-Frequency Monopole

Figure 13:
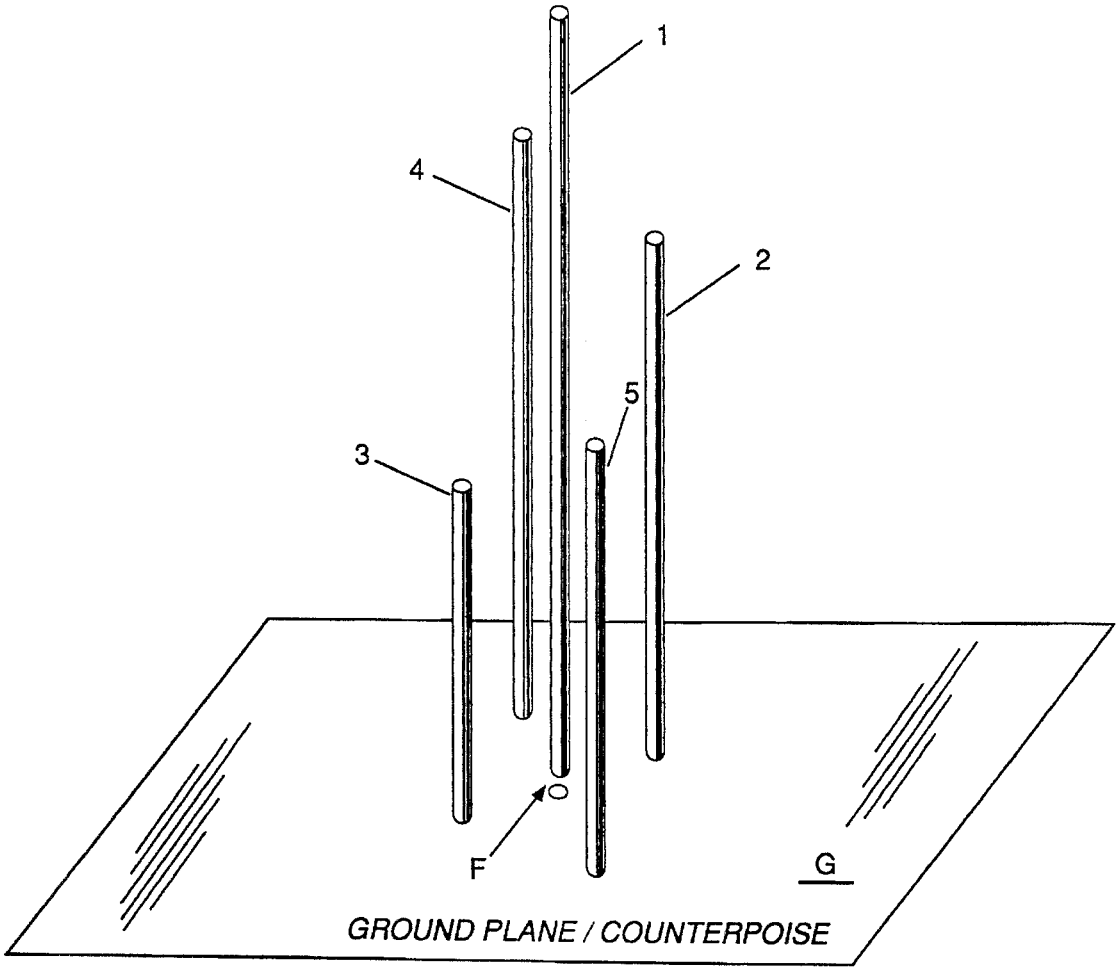
FIG. 13 is a perspective view illustrating a five-frequency monopole antenna according to the present invention.
Figure 14:
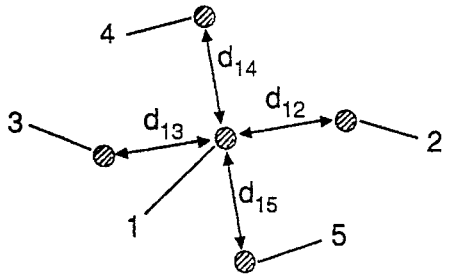
FIG. 14 is a top plan view illustrating a five-frequency monopole antenna of FIG. 13.

The fifth frequency added in connection with the analysis of the antenna shown in FIGS. 13 and 14 was 18.1 MHz. The pattern established of a small change in capacitive reactance was followed in this case, as well. At 10.1, 14.0 and 18.1 MHz, the net impedance change is approximately 1.2 to 1.5%. At 24.9 MHz, the larger change observed in the four-frequency case continued, with computed impedance of 34.0–j37 ohms, compared to 36+j0 ohms in the two-frequency case.

Figure 15:
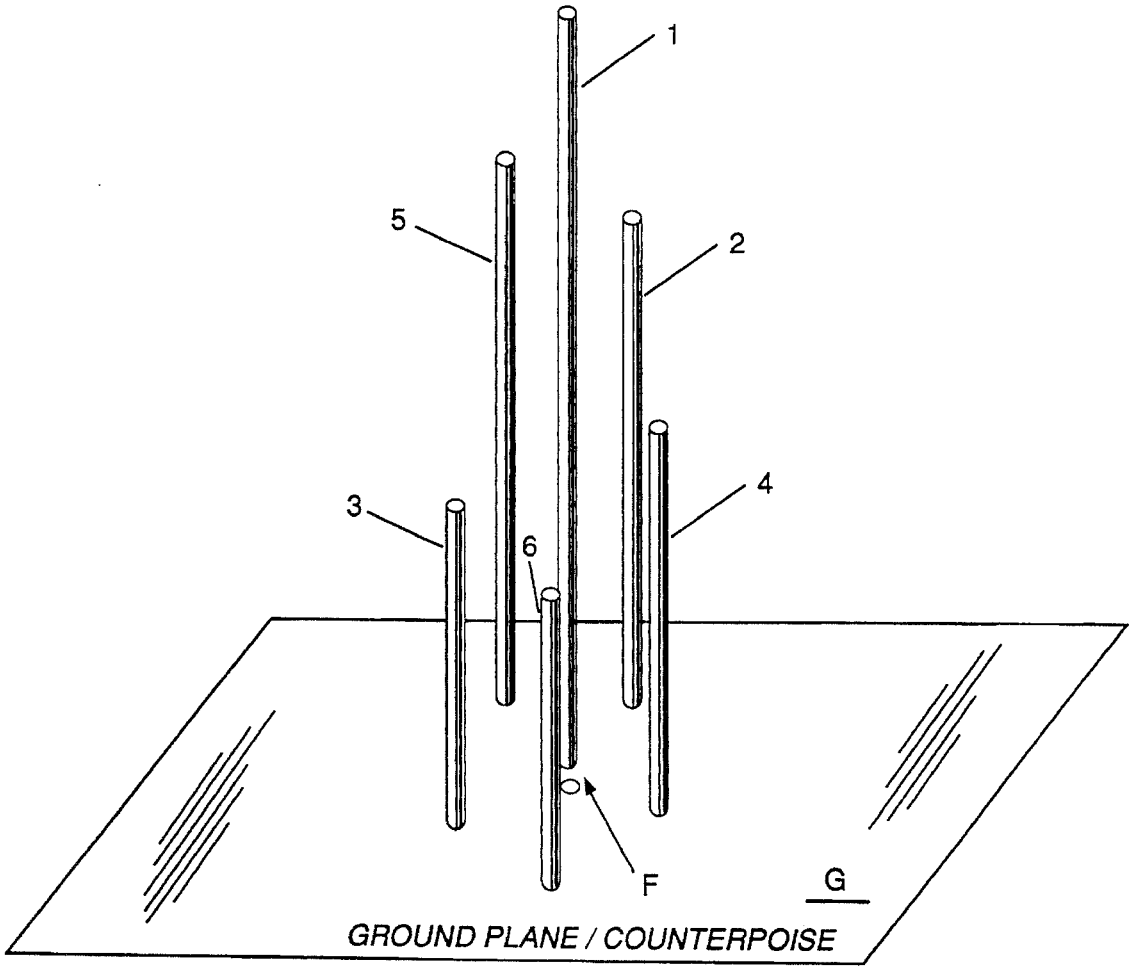
FIG. 15 is a perspective view illustrating a six-frequency monopole antenna according to the present invention.
Figure 16:
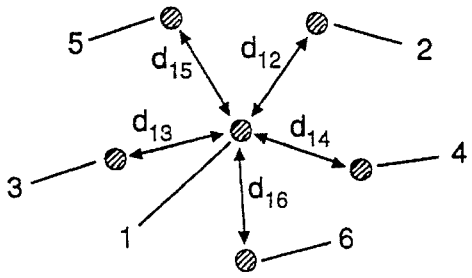
FIG. 16 is a top plan view illustrating the six-frequency monopole antenna of FIG. 15.

Six-Frequency Monopole 28.0 MHz was added as the sixth frequency in the analysis of antenna of the type shown in FIGS. 15 and 16. The pattern observed in prior models continued with predictability. 10.1, 14.0, 18.1 MHz showed impedance changes of 1.5 to 2.0% compared to the two-frequency base line models, while the 24.9 MHz impedance became more capacitive at a faster rate. The 28.0 MHz impedance showed an even greater variation than 24.9 MHz, with a computed impedance of 33–j56 ohms, compared to 36+j0 ohms in the two-frequency case.

Seven-Frequency Monopole

Figure 17:
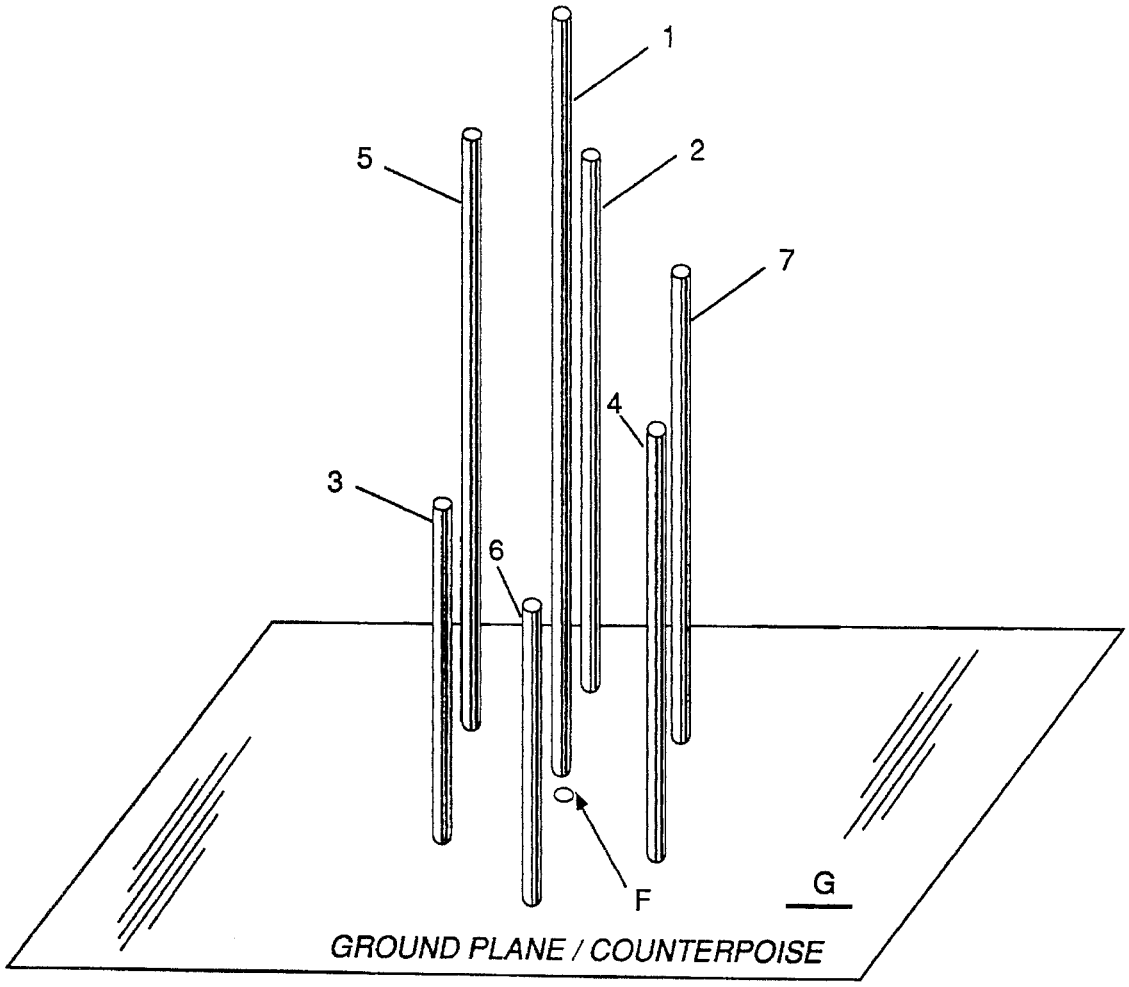
FIG. 17 is a perspective view illustrating a seven-frequency monopole antenna according to the present invention.
Figure 18:
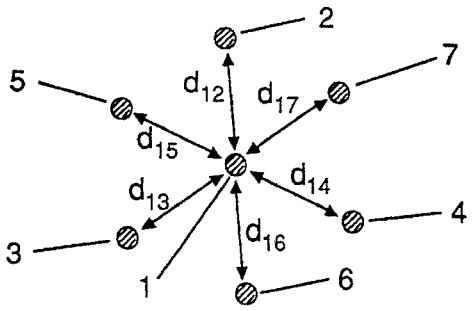
FIG. 18 is a top plan view illustrating the seven-frequency monopole antenna of FIG. 17.

In connection with the analysis of the antenna shown in FIGS. 17 and 18 an additional conductor at 21.0 MHz was added to the system. The trend established by the previous models continued, with the higher frequencies showing the greatest deviation from the base line of the two-frequency configuration.

Summary Notes

The increasing capacitive reactance with the addition of more resonators is consistent with the increased capacitance due to the proximity of the additional conductors. The resistive component of the impedance was decreased by approximately 9 percent (from 36 ohms to a typical 33 ohms) in the seven-frequency model, with progressively less change in the smaller models. However, had the physical lengths of the resonators been increased to compensate for the capacitive reactance, the resistive component would have increased, negating a portion of the observed change.

It is to be understood, however, that even though numerous characteristics and advantages of the present invention have been set forth in the foregoing description, together with details of the structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed.

What is claimed is:

1. A method of making a multiple-frequency antenna or antenna element that exhibits resonance at multiple arbitrary predetermined frequencies at a single feedpoint, comprising the steps of:

providing a driven conductor operative on a first arbitrary predetermined frequency and including a feedpoint, said driven conductor comprising a one-half wavelength dipole;

providing a non-driven conductor which is one-half wavelength resonant at a second arbitrary predetermined frequency different from said first frequency; and disposing said driven and non-driven conductors in a substantially parallel spaced relationship at a predetermined spacing to electromagnetically couple said driven and non-driven conductors and produce a non-reactive impedance at said feedpoint at both said first and second frequencies, wherein said predetermined spacing of said driven and non-driven conductors is determined according to the equation:

$$d_{12}=10^{[0.54Log(D/4)]}\times\frac{Z_0+35.5}{109}\times[1+e^{-[(((F_2/F_1)-1.1)\times 11.3)+0.1]}]$$

where, $d_{12}$ is the spacing on centers between the driven and non-driven conductors, expressed in wavelengths at said second frequency;

D is the diameter of the driven and non-driven conductors, expressed in wavelengths at said second frequency;

$Z_0$ is the desired impedance at said second frequency;

$F_1$ is the resonant frequency of said driven conductor; and $F_2$ is the resonant frequency of said non-driven conductor.

2. A method of making a multiple-frequency antenna or antenna element that exhibits resonance at multiple arbitrary predetermined frequencies at a single feedpoint, comprising the steps of:

providing a driven conductor operative on a first arbitrary predetermined frequency and including a feedpoint, said driven conductor comprising a one-quarter wavelength monopole;

providing a non-driven conductor which is one-quarter wavelength resonant at a second arbitrary predetermined frequency different from said first frequency; and disposing said driven and non-driven conductors in a substantially parallel spaced relationship at a predetermined spacing to electromagnetically couple said driven and non-driven conductors and produce a non-reactive impedance at said feedpoint at both said first and second frequencies, wherein said predetermined spacing of said driven and non-driven conductors is determined according to the equation:

$$d_{12}=10^{[0.54Log(D/4)]}\times\frac{Z_0+35.5}{109}\times[1+e^{-[(((F_2/F_1)-1.1)\times 11.3)+0.1]}]$$

where, $d_{12}$ is the spacing on centers between the driven and non-driven conductors, expressed in wavelengths at said second frequency;

D is the diameter of the driven and non-driven conductors, expressed in wavelengths at said second frequency;

$Z_0$ is twice the desired impedance at said second frequency;

F1 is the resonant frequency of said driven conductor; and $F_2$ is the resonant frequency of said non-driven conductor.

3. A multiple-frequency antenna or antenna element that exhibits resonance at multiple arbitrary predetermined frequencies at a single feedpoint, comprising:

a driven conductor operative on a first arbitrary predetermined frequency and including a feedpoint;

a number n of non-driven conductors resonant at a number n of respective additional arbitrary predetermined frequencies different from said first frequency, wherein n is at least one;

said driven and non-driven conductors disposed in substantially parallel spaced relationship at a predetermined spacing to electromagnetically couple said driven and non-driven conductors and produce a non-reactive impedance at said feedpoint at said first arbitrary predetermined frequency and at each of said n additional frequencies; and said predetermined spacing of said driven and non-driven conductors determined according to the equation:

$$d_{1n}=10^{[0.54Log(D/4)]}\times\frac{Z_0+35.5}{109}\times[1+e^{-[(((F_n/F_1)-1.1)\times 11.3)+0.1]}]$$

where, $d_{1n}$ is the spacing on centers between the driven and non-driven conductors, expressed in wavelengths at said n additional frequency;

D is the diameter of the driven and non-driven conductors, expressed in wavelengths at said n additional frequency;

$Z_0$ is the desired feedpoint impedance at said n additional frequency when the antenna element is a dipole, or twice the desired impedance when the antenna element is a monopole;

$F_1$ is the resonant frequency of the driven conductor; and $F_n$ is the resonant frequency of said n non-driven conductor.

* * * * *